US006260311B1

(12) United States Patent
Vladikovic

(10) Patent No.: US 6,260,311 B1
(45) Date of Patent: Jul. 17, 2001

(54) CONCRETE FORM SUSPENSION SYSTEM AND METHOD

(76) Inventor: Peter Vladikovic, 2743 West 37th Avenue, Vancouver (CA), V6N 2T5

( * ) Notice: Subject to any disclaimer, the term of this patent is extended or adjusted under 35 U.S.C. 154(b) by 0 days.

(21) Appl. No.: 09/247,927

(22) Filed: Feb. 11, 1999

(51) Int. Cl.[7] ..... B66C 13/04

(52) U.S. Cl. ..... 52/122.1; 52/126.7; 52/126.6; 52/126.1; 52/29; 52/114; 52/125.1; 249/20; 249/28

(58) Field of Search ..... 52/29, 30, 33, 52/111, 114, 122.1, 125.1, 126.1, 745.12, 745.2, 749.1, 126.7, 126.6, 745.13, 749.13; 249/20, 19, 28, 188; 264/33

(56) References Cited

U.S. PATENT DOCUMENTS 1,701,113 * 2/1929 Keller ..... 249/20
3,096,076 * 7/1963 Walli ..... 52/125.1 X
3,510,098 * 5/1970 Fox ..... 249/20
3,851,736 * 12/1974 Westlake et al. ..... 52/30 X
4,029,286 * 6/1977 Ahl ..... 249/19
4,345,671 * 8/1982 Tosato et al. ..... 52/745.2
4,991,365 * 2/1991 Jackson ..... 52/126.6
5,088,263 * 2/1992 Horii et al. ..... 52/745.13
5,490,367 * 2/1996 Lee ..... 52/749.1
5,970,680 * 10/1999 Powers ..... 52/745.2 X
6,082,058 * 7/2000 Deng ..... 52/745.2 X

* cited by examiner

*Primary Examiner*—Carl D. Friedman
*Assistant Examiner*—Phi Dieu Tran A

(57) ABSTRACT

A concrete form suspension system has a form support projecting laterally from an upper portion of a vertically displaceable support structure and a hydraulic jack operable to raise the support structure along a vertically extending concrete structure. A support device can be secured to the concrete structure for supporting the jack and support brackets can be secured to the concrete structure for supporting the raised support structure from the concrete structure. By operation of the jack, the support structure can climb the concrete structure to allow concrete forms suspended from the form support to be located in position for use in upwardly extending the concrete structure.

22 Claims, 8 Drawing Sheets

CONCRETE FORM SUSPENSION SYSTEM AND METHOD

BACKGROUND OF THE INVENTION

1. Field of the Invention

The present invention relates to a concrete form suspension system and to a method of suspending and raising concrete forms during the erection of a concrete structure.

2. Description of the Related Art

In the construction of concrete buildings, forms used for the casting of concrete to form the walls of the building need to be lifted, after each storey of the building is completed, and repositioned for the casting of the next storey. For this purpose, cranes are usually employed and, therefore, the cranes need to be in operation and on standby for considerable periods of time for the raising of the forms from storey to storey.

BRIEF SUMMARY OF THE INVENTION

It is an object of the present invention to provide a novel and improved concrete form suspension system which avoids the use of cranes for lifting forms as the construction of a concrete structure proceeds.

According to the present invention, a concrete form suspension system comprises a vertically displaceable support structure, a form support projecting laterally from an upper portion of the support structure, a lifting device operable to raise the support structure along a vertically extending concrete structure, a support device for supporting the lifting device, the support device being secured to the concrete structure, and support numbers for supporting the support structure from the concrete structure, the support members being securable to the concrete structure.

When a system according to the present invention is in use, the support structure is firstly raised along the concrete structure by operation of the lifting device, which is supported on the concrete structure. The support members are then employed to support the support structure in a raised position, so that a concrete form suspended from the support structure can be correctly positioned for forming a further portion of the concrete structure. When this further portion of the concrete structure has been completed, the support device, or another support device, is positioned higher on the concrete structure and the support structure is again raised. The further support members can then be repositioned at higher locations than their original locations and, in these higher locations, serve to support the support structure in a second raised position higher than its first raised position. This sequence of operations can be repeated until the top of the concrete structure has been cast.

In a preferred embodiment of the invention, alignment members which are extensible and retractable between the support structure and the concrete structure, are employed for adjustably horizontally positioning the support structure relative to the concrete structure.

The alignment members are mounted on opposite sides of the support structure and project laterally from the support structure for engagement with the concrete structure.

In this preferred embodiment, a first pivotal connection is provided between the lifting device and the support structure and a second pivotal connection is provided between the lifting device and the support device. The first and second pivotal connections allow pivotation between the lifting device, on one hand, and the support structure and the concrete structure, on the other hand, thus facilitating horizontal adjustment of the support structure, for ensuring correct vertical alignment of the support structure in the raised position, without damage to the lifting device.

In this preferred embodiment of the invention, the lifting device comprises a substantially extending jack, the first pivotal connection with being provided between an upper end of the jack and the support structure and the second pivotal connection with being provided between the lower end of the jack and the support device secured to the concrete structure.

BRIEF DESCRIPTION OF THE DRAWINGS

The invention will be more readily understood from the following description of a preferred embodiment thereof given, by way of example, with reference to the accompanying drawings, in which.

DESCRIPTION OF THE PREFERRED EMBODIMENT

Figure 1:
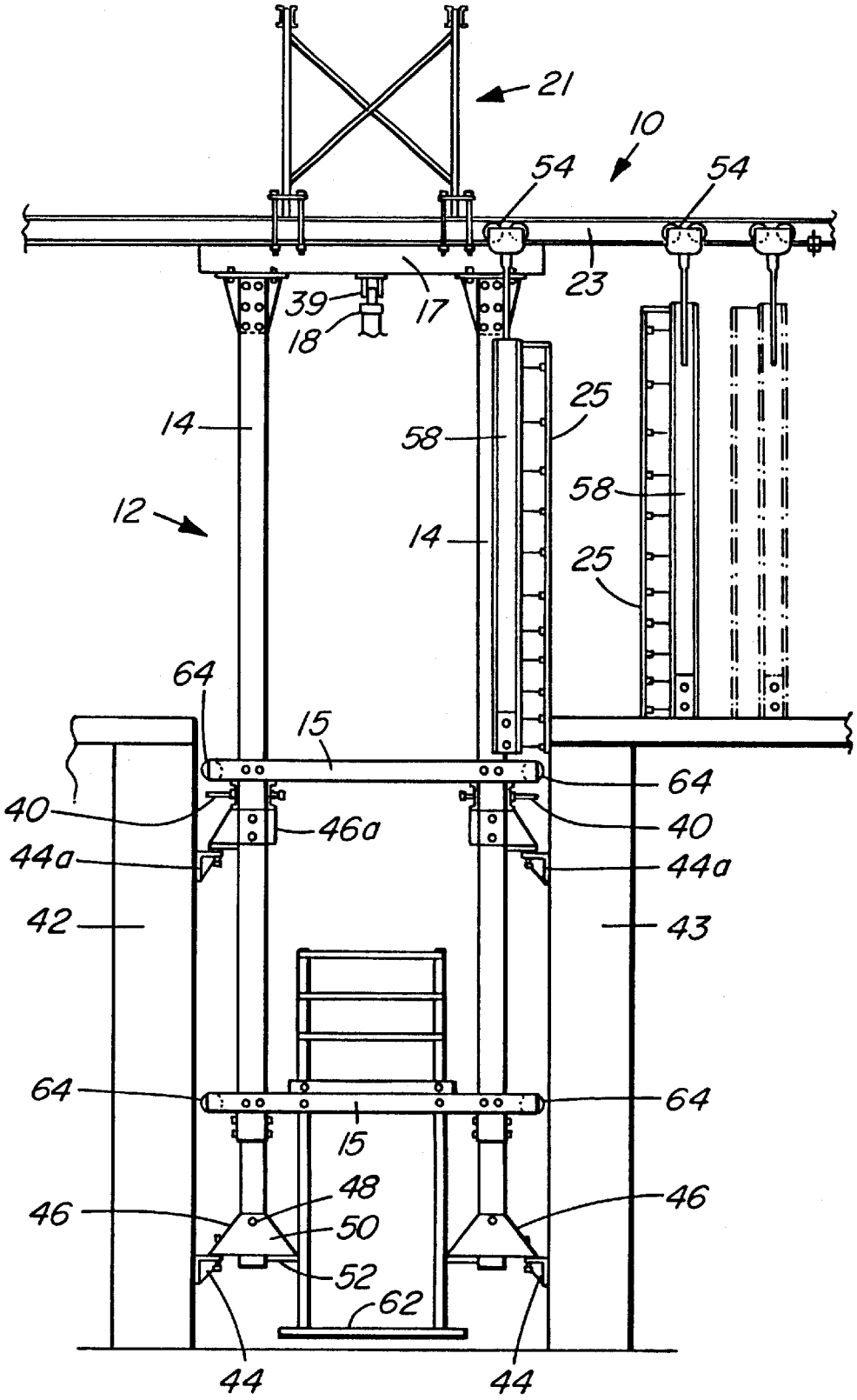
FIG. 1 shows a view of a concrete form suspension system according to the present invention taken in section along the line 1—1 of FIG. 2.

In FIG. 1 of the accompanying drawings, reference numeral 10 indicates generally a concrete form suspension system which comprises a rigid support structure indicated generally by reference numeral 12.

Figure 2:
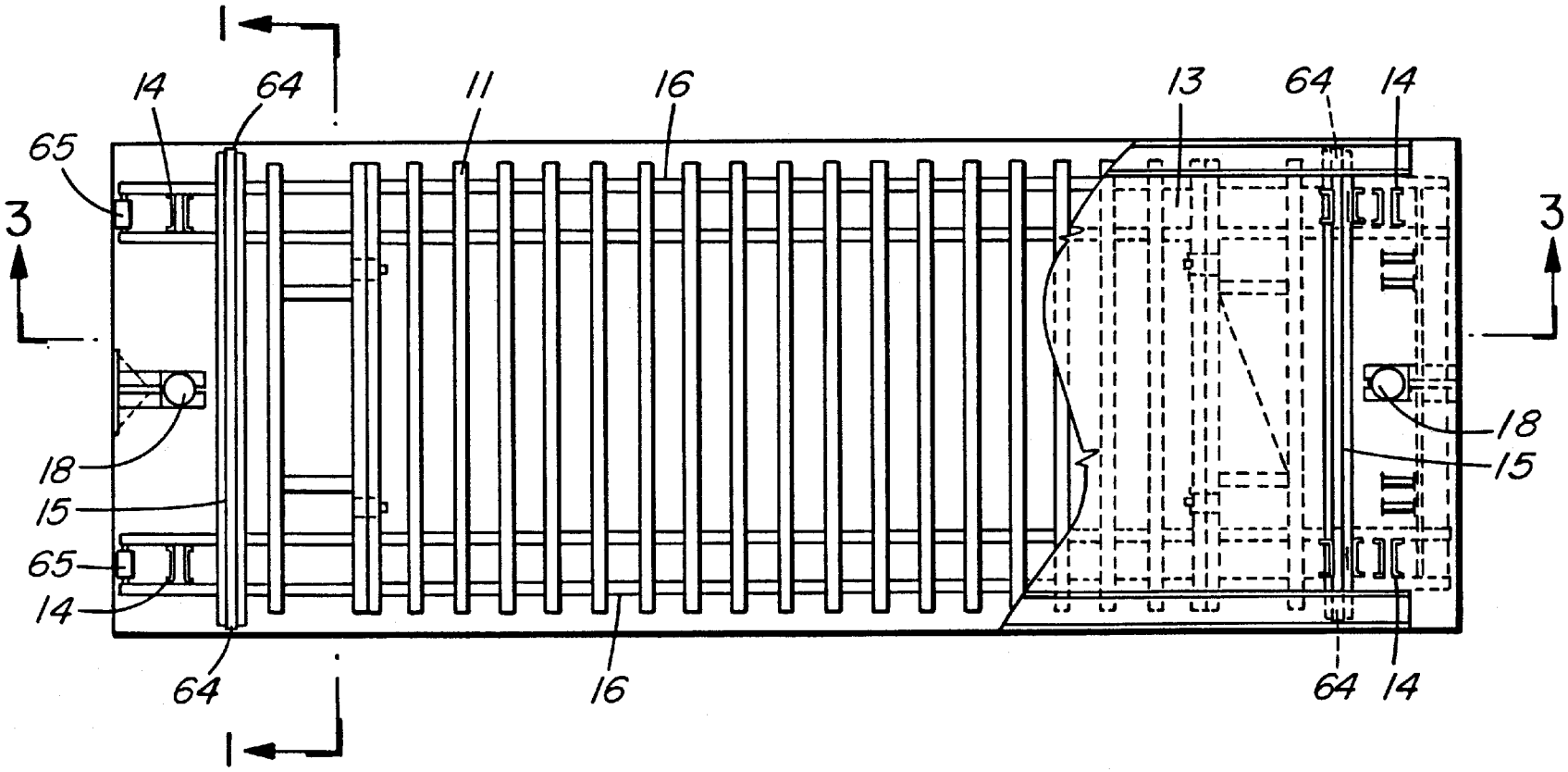
FIG. 2 shows a plan view of the concrete form suspension system of FIG. 1.
Figure 3:
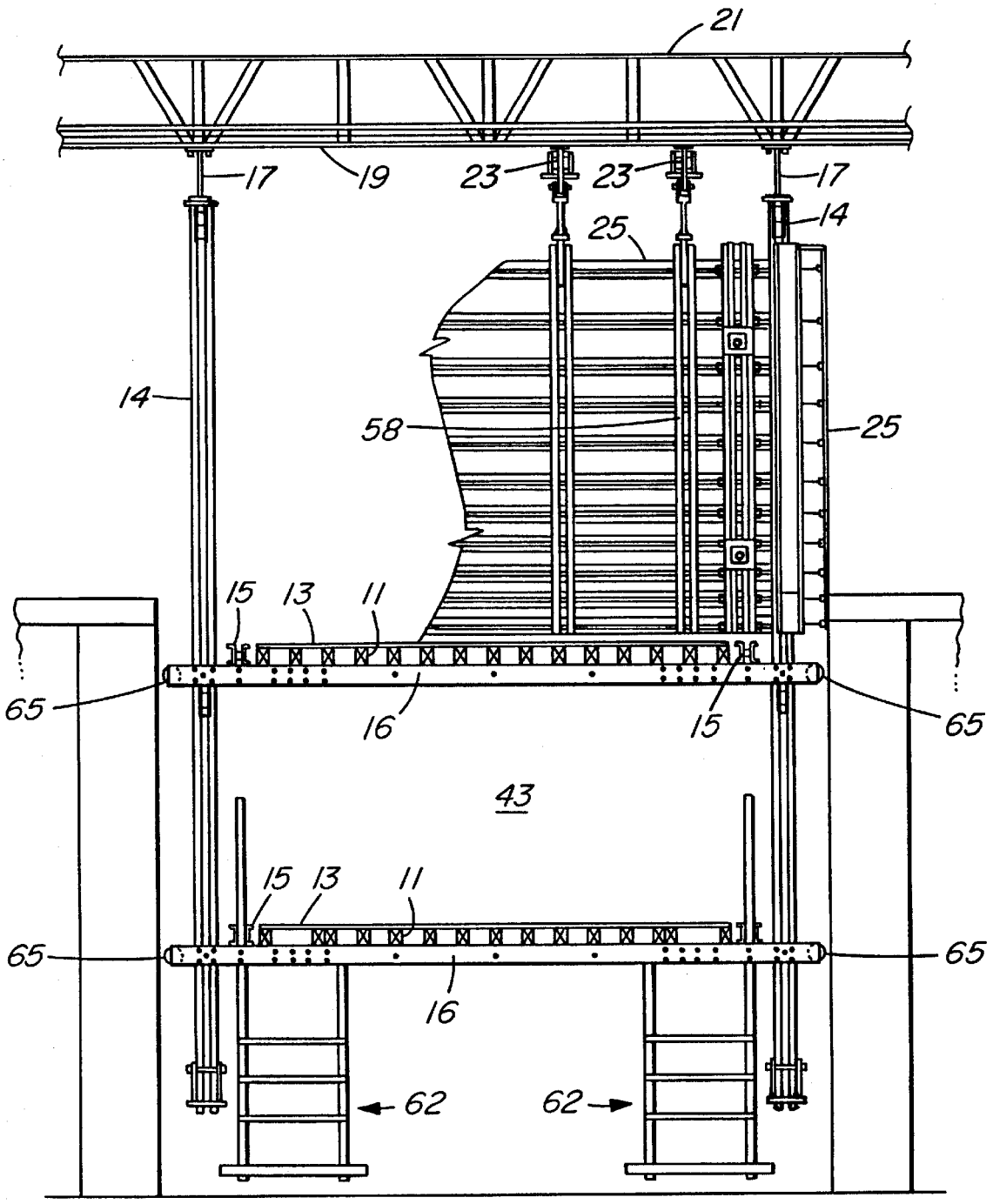
FIG. 3 shows a view taken in section along the line 3—3 of FIG. 2.

As shown in FIGS. 1 through 3, the rigid support structure 12 comprises two pairs of vertical beams 14 which are each formed of two channel members and which are spaced apart horizontally from one another and which are connected together by upper and lower horizontal deck beams 16 extending longitudinally of the support structure 12. The deck beams 16 carry a deck formed by joists 11 and plywood 13. The deck beams 16, in turn, are connected by horizontal spreader beams 15 extending transversely of the support structure 12. At the top of the support structure 12, there is provided a horizontal carrier beam 17 supporting a bottom cord 19 of a truss indicated generally by reference numeral 21. The truss 21, which for convenience of illustration is shown partly broken away in FIG. 3, carries transverse secondary beams 23 which, as shown in FIG. 1, project laterally from the support structure 12 and which serve to carry concrete forms 25, as described in greater detail below.

Figure 1A:
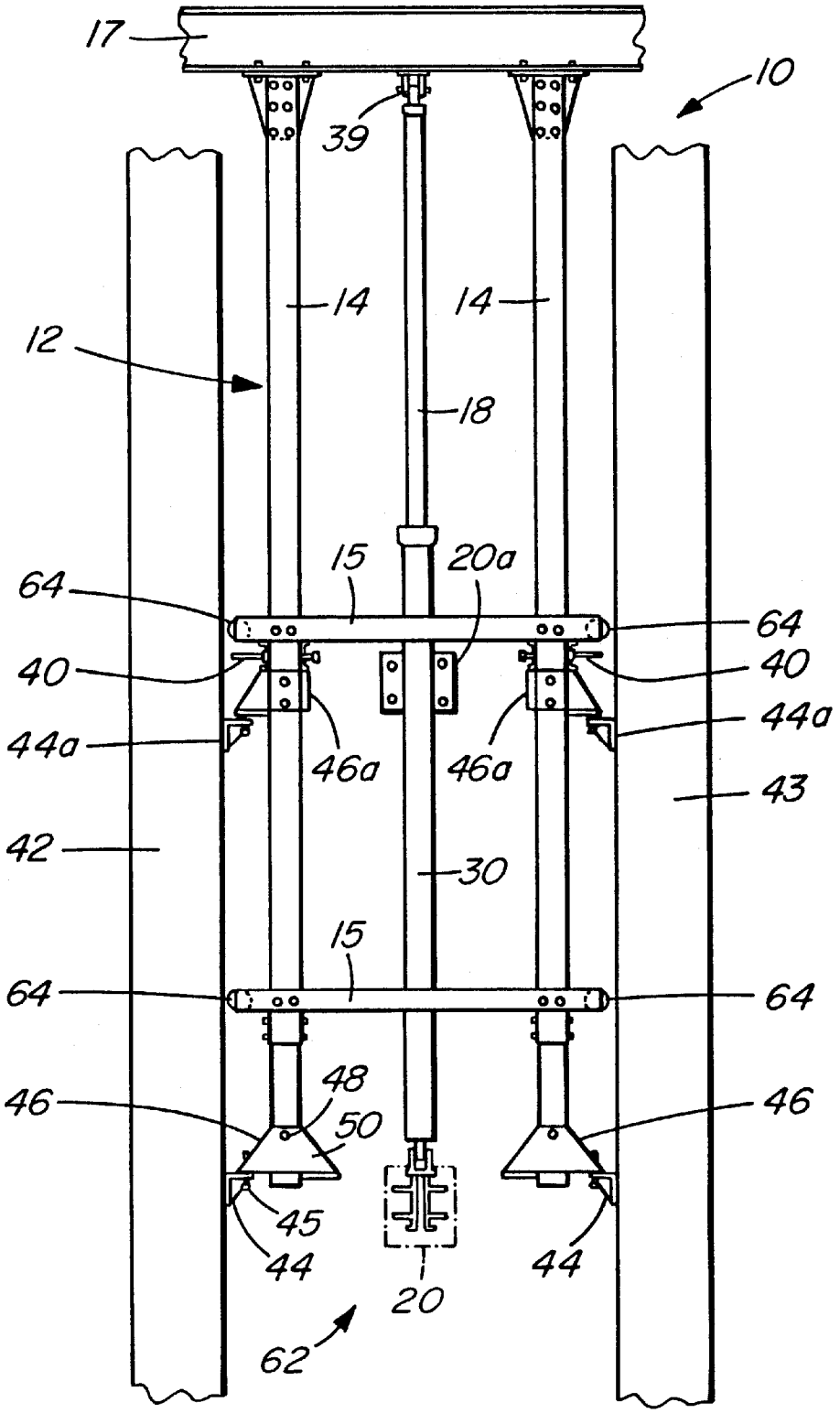
FIG. 1A shows a view similar to FIG. 1 but with some parts omitted to facilitate the illustration of other parts of the system.

The concrete form suspension system 10, at opposite ends thereof, also includes a pair of lifting devices in the form of vertical hydraulic jacks 18, one of which is shown in FIG. 1A in an extended condition.

Figure 4:
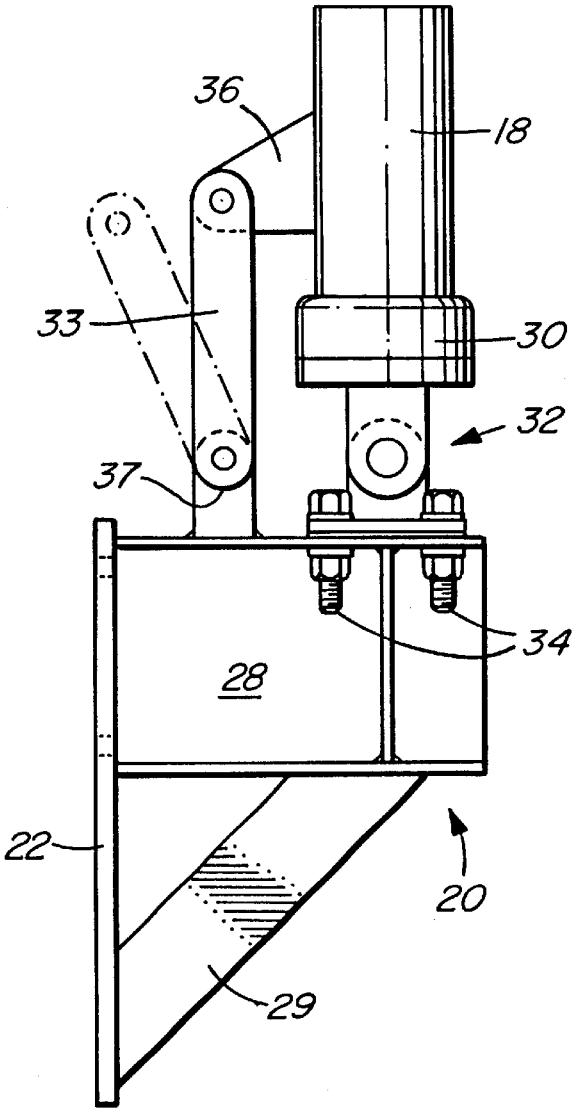
FIGS. 4 and 5 are views in side and front elevation, respectively, of a support device forming part of the form suspension system of FIGS. 1 and 2.
Figure 5:
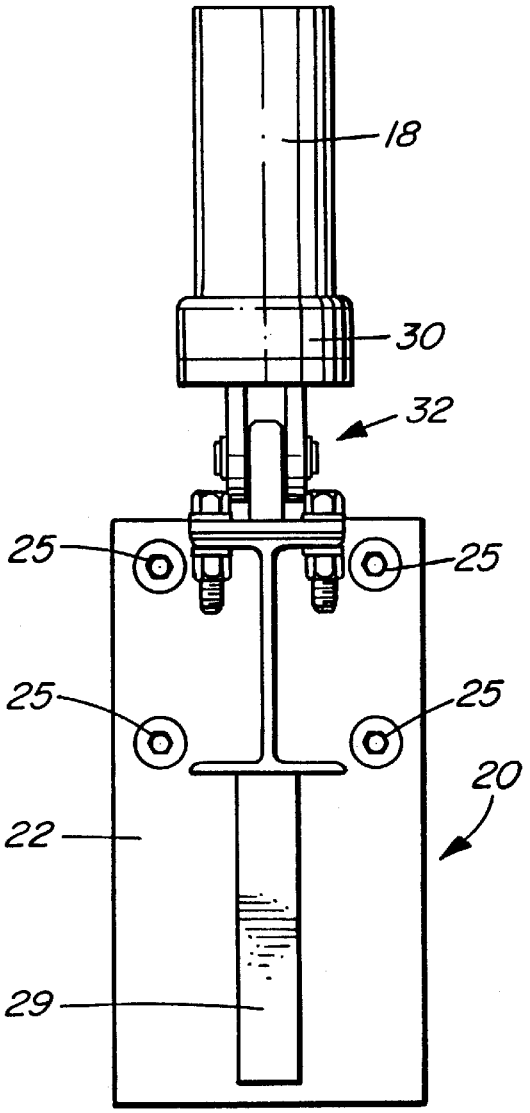

A lower end 30 of each hydraulic jack 18 is supported by a respective support device, one of which is indicated generally by reference numeral 20 in FIG. 1A and illustrated in greater detail in FIGS. 4 and 5.

The support device 20 comprises a vertical rectangular plate 22 through which bolts 25 are inserted for mounting the support device 20 on the vertical face of a wall 26 forming part of a concrete structure. A short, horizontal H-beam 28 is welded at one end to the plate 20, with a support strut 29 extending between the plate 22 and the H-beam 28 and welded at opposite ends to the H-beam 28 and to the plate 22. A lower pivot connection, indicated generally by reference numeral 32, is secured by bolts 34 to the H-beam 28 and pivotally connects the lower end 30 of the jack 18 to the support device 20.

The support device 20, also includes a retainer in the form of a tie bar 33 pivotally secured at opposite ends to lugs 36 and 37 provided on the lower end 30 of the jack 18 and on the top of the support device 20. The purpose of the tie bar 33 is to hold the support device 20 in the orientation in which it is shown in FIGS. 4 and 5 when the support device 20 is unbolted from the wall 26 to enable the support device 20 to be raised by its jack 18, as described in greater detail below.

An upper end 38 of the jack 18 is secured, by a pivot connection indicated generally by reference numeral 39 in FIG. 1A of the drawings, to the horizontal carrier beam 17.

The support structure 12 is provided, at opposite sides of the support structure 12, with alignment members, in the form of form aligner plumbing bolts, indicated generally by reference numerals 40. The alignment members 40 are extensible and retractable relative to the support structure 12, and extend between the opposite sides of the support structure 12 and the faces of concrete walls 42 and 43 forming parts of the concrete structure. By adjusting the alignment members 40, the entire support structure 12 can be horizontally displaceably adjusted into an operational position, in which the support structure 12 is correctly vertically aligned, and this horizontal displacement of the support structure 12 is facilitated by the pivotal connections 32 and 39.

Figure 6:
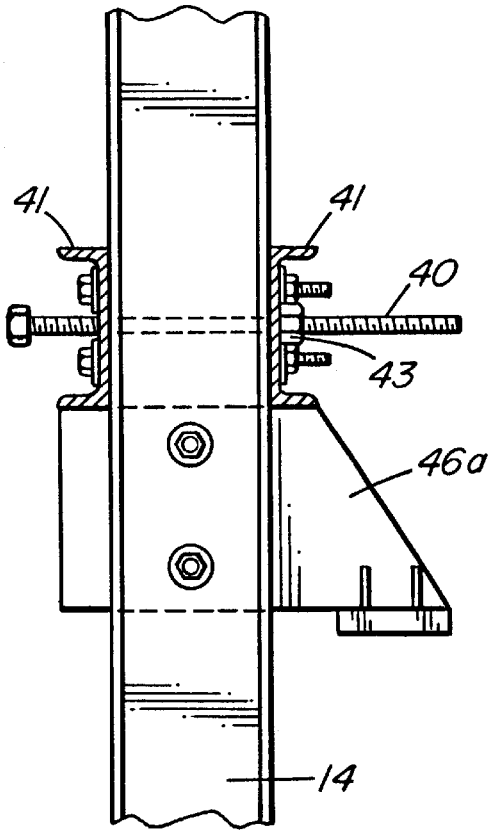
FIGS. 6 and 7 show views in side and end elevation, respectively, of an alignment member in the system of FIGS. 1 through 3.
Figure 7:
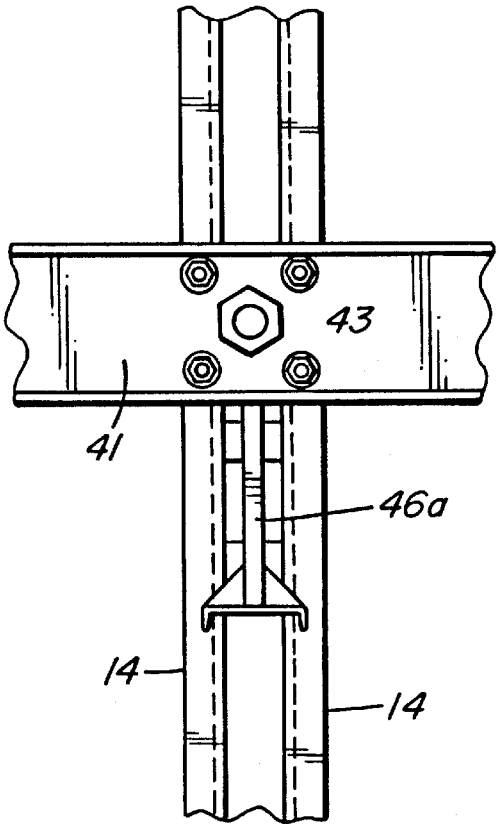

One of the bolts 40 is shown in greater detail in FIGS. 6 and 7, from which it can be seen that the bolts 40 extend horizontally through metal channels 41 secured to opposite sides of the vertical beams 14 and forming the spreader beams 15. The bolt 40 is in threaded engagement with a nut 43 welded to one of the metal channels 41. On rotation of the bolt 40, a free end of the bolt is moved outwardly or inwardly with respect to the structure 12, thus horizontally adjusting the latter.

Figure 8:
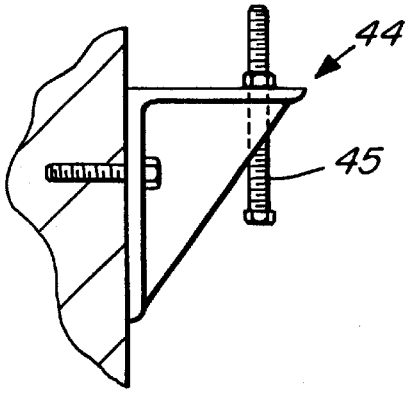
FIGS. 8 and 9 show side and front views, respectively, of a support bracket forming part of the system of FIGS. 1 to 3.
Figure 9:
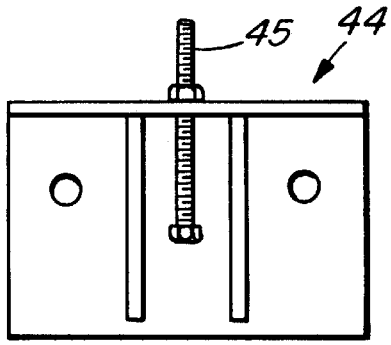
Figure 10:
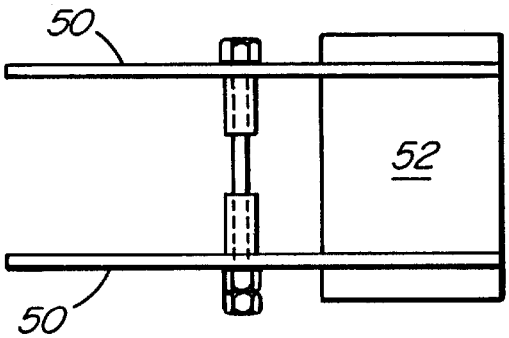
FIG. 10 shows a plan view of a lateral projection forming part of the system of FIGS. 1 through 3.

The concrete form suspension system 10 also includes support members in the form of lower support brackets indicated generally by reference numerals 44, and upper support brackets, indicated generally by reference numerals 44a, which are similar to one another and which are bolted to the vertical faces of the concrete walls 42 and 43. FIGS. 8. and 9 show one of the support brackets 44 in greater detail and, as shown in FIGS. 8 and 9, the bracket 44 has a vertically adjustable leveling bolt 45. The support structure 12 is provided, at the lower ends of the vertical beams 14, with lateral projections, indicated generally by reference numerals 46, which are pivotable about pivot pins 48 extending through the lower ends of the vertical beams 14. A plan view of one of the projections 46 is shown in FIG. 10, from which it can be seen that the lateral projection 46 comprises a pair of plates 50 connected by a rectangular plate 52 which, on pivotation of the projection 46 into the position in which it is shown in FIG. 1, abuts one side of the vertical beam 14.

Figure 11:
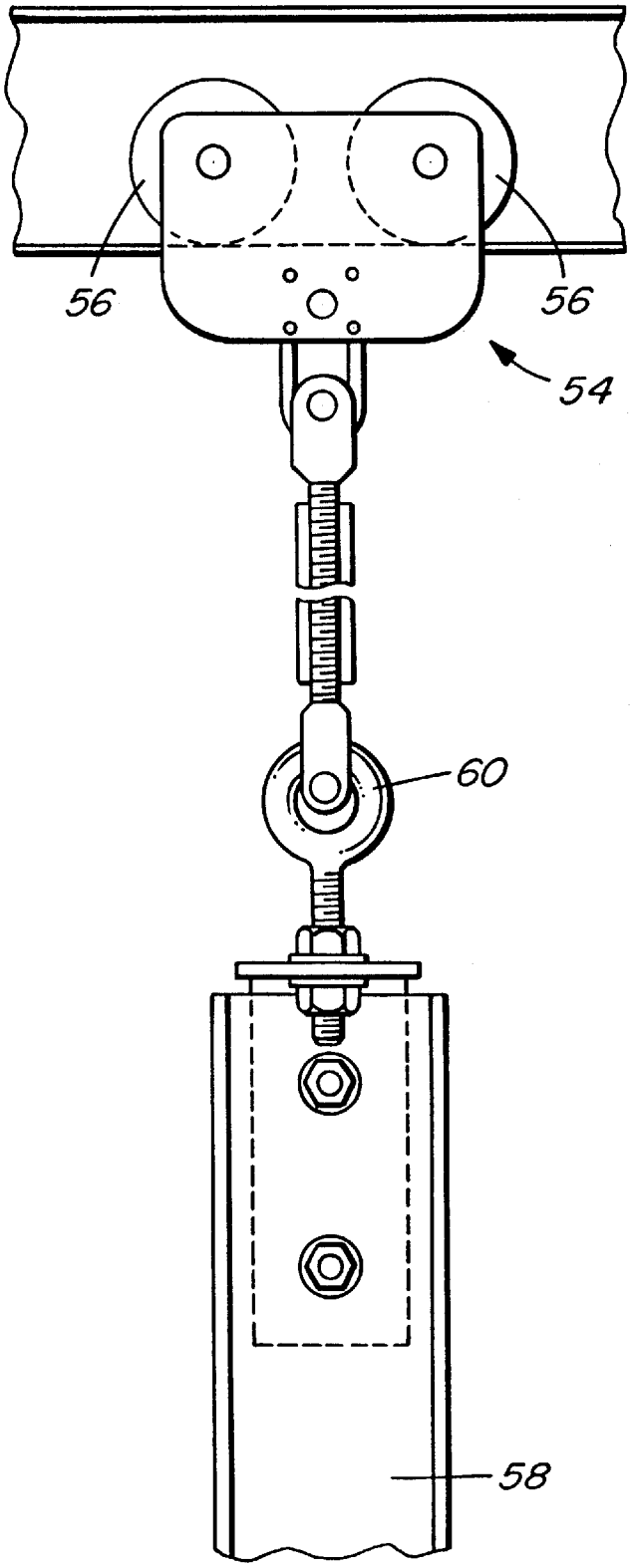
FIG. 11 shows a broken-away view of parts of the concrete form suspension system of FIGS. 1 through 3 and, more particularly, shows a concrete form suspension trolley.

The beams 23 support concrete form suspension trolleys, which are indicated generally by reference numerals 54 in FIG. 1 and, as shown in greater detail in FIG. 11, are supported on rollers 56 to so as to be displaceable horizontally to and from along the beams 23, which project laterally from the support structure 12. A vertical beam 58 is suspended from the trolley 54 by means of an eye 60 and a turnbuckle 62 and carries one of the concrete forms 25, as shown in F1G. 1.

Figure 12:
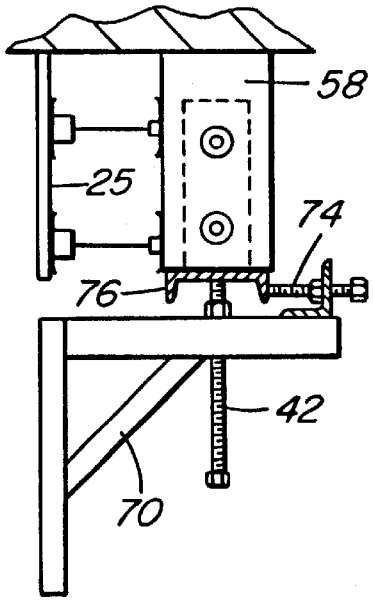
FIG. 12 shows a view in side elevation of a leveling bracket.

FIG. 12 shows a leveling bracket 70 which can be bolted to the concrete structure for adjusting the position of one of the vertical beams 58 and, thereby, the position of the form secured to the beam 58. For this purpose, the bracket 70 has vertical and horizontal adjustment bolts 72 and 74, which engage a channel section 76 secured to the lower end of the beam.

In operation of the above-described concrete form suspension system 10, the support members 44 are firstly installed by bolting onto the concrete walls 42 and 43. Also, the support devices 20 are bolted onto the concrete structure in first positions in one of which one of them is shown in FIG. 1A. The lower ends of the jacks 18 are then connected, by the lower pivotal connections 32, to the support devices 20, with the carrier beams 17 connected to the upper ends of the jacks 18 by the upper pivotal connections 39. The bolting of the support devices 20 onto the concrete structure and the connections of the lower ends of the jacks 18 to the support devices 20 are facilitated by the provision of cages, indicated generally by reference numerals 62 in FIGS. 1 and 3, which are suspended from the lowermost beams 15 and 16 and into which the personnel operating the system can enter.

With the forms 25 suspended from the beams 23, the jacks 18 are then extended to raise the support structure 12 along the concrete structure to a first position, in which it is shown in FIGS. 1 and 1A. During the raising of the support structure 12, rollers 64 and 65 at opposite ends of the horizontal beams 15 and 16 roll along the adjacent wall surfaces of the concrete structure and, thus, serve as guide rollers for guiding the support structure 12 during the upward movement of the latter.

When the lateral projections 46 reach the support members 44*a*, the lateral projections 46 are pivoted so as to be deflected out of the way of the support members 44*a*. When the support structure 12 as been raised sufficiently, the projections 46 pivot back, in opposite directions, until the plates 52 again abut the vertical beams 14. The plates 50 then rest on, and are supported by, the support members 44*a*. Also, the upper support members 44*a* are installed on the concrete structure and adjusted to support upper lateral projections 46*a* fixed to the vertical beams 14.

The alignment members 40 are adjusted into pressing engagement with the walls 42 and 43 to thereby exert a force against the concrete structure so as to effect horizontal adjustment of the support structure 12 relative to the walls 42 and 43 and thereby to correctly vertically align the support structure 12. Also, the vertically adjustable bolts of the support members 44 are adjusted for correctly leveling the support structure 12. The horizontal adjustment displacement of the support structure 12 is accommodated by pivotation of the hydraulic jack 18, made possible by the provision of the upper and lower pivotal connections 32 and 39.

When the support structure 12 has thus been raised into the first raised position and then adjusted horizontally and vertically into its correct operational position, as described above, the trolleys 50 can be moved horizontally along the beams 23 to locate the concrete forms, suspended from the trolleys 54, into position for subsequent adjustment by the leveling bracket bolts 72 and 74 prior to the pouring of concrete to form a further portion of the concrete structure.

The support devices 20 are then unbolted from the concrete and raised by the jacks 18 to enable them to be installed on the concrete wall 26 in higher positions, one of which is shown in broken lines in FIG. 1 A and indicated generally by reference numeral 20*a*. On subsequent extension of the hydraulic jacks 18, the entire support structure 12 is again raised from the position shown in FIGS. 1 and 1A to a second raised position (not shown), in which the lateral projections 46 are supported on the upper support members 44*a*. The above-described adjustment of the support structure 12 into a new operating position is then repeated.

By this means, the concrete form suspension system 10 can be caused to raise itself along the concrete structure as the latter is erected. The present concrete form suspension system 10, therefore, enables easy and time-saving raising of the concrete forms 25 through successive positions of use. The lateral projections 46, which pivot back into the positions in which they are shown in FIG. 1 after being raised past the wall-mounted support members 44, ensure that the support structure 12 cannot drop downwardly past the support members 44 or 44*a*.

Various modifications may be made in the above-described concrete form suspension system within the scope of the present invention. For example, the hydraulic jack 18 may be replaced by an electrical lifting device. Also, the positions of the horizontally extending beams, the support members 44 and 44*a*, the alignment members 40 and other components of the system may be varied, as required, to suit prevailing conditions.

I claim:

1. A method of suspending and raising a concrete form during the erection of a concrete structure, comprising the steps of:

suspending the concrete form from a support structure;

raising the support structure upwardly along the concrete structure to a first raised position by a lifting device supported in a first position on the concrete structure;

supporting the support structure from the concrete structure in a first raised position;

employing the concrete form while the support structure is in the first raised position;

supporting the lifting device on the concrete structure in a second location on the concrete structure, the second position being higher than the first position;

raising the support structure, by means of the lifting device, from the first raised position to a second raised position higher than the first raised position and supporting the support structure from the concrete structure in the second raised position.

2. A method as claimed in claim 1, which includes effecting horizontal adjustment of the support structure in the first raised position.

3. A method as claimed in claim 2, which includes exerting a force against the concrete structure to effect the horizontal adjustment of the support structure.

4. A method as claimed in claim 2, which includes providing pivotal connections between the lifting device and the support structure and between the lifting device and the concrete structure to facilitate the horizontal adjustment of the support structure.

5. A concrete form suspension system, comprising:

a vertically displaceable support structure;

a form support projecting laterally from an upper portion of said support structure;

a lifting device operable to raise said support structure along a vertically extending concrete structure;

a support device supporting the lifting device;

said support device being provided with means for securing said support device to a vertical face of said concrete structure;

support members supporting said support structure from said concrete structure;

said support members being provided with means for securing said support members to vertical faces of said concrete structure; and alignment members which are extensible and retractable between said support structure and said concrete structure for adjustably horizontally positioning said support structure relative to said concrete structure.

6. A concrete form suspension system as claimed in claim 5, wherein said alignment members are mounted on opposite sides of said support structure for engagement with said concrete structure.

7. A concrete form suspension system as claimed in claim 5, further comprising guide rollers on opposite sides of said support structure for rolling engagement with said concrete structure during the raising of said support structure.

8. A concrete form suspension system as claimed in claim 5, further comprising a pivotal connection between said lifting device and said support structure.

9. A concrete form suspension system as claimed in claim 5, wherein said lifting device comprises a vertical lifting jack, said system further comprising an upper pivotal connection between an upper end of said jack and said support structure, and a lower pivotal connection between said support device and a lower end of said jack, said pivotal connections permitting horizontal adjustment of said support structure relative to said concrete structure.

10. A concrete form suspension system as claimed in claim 5, wherein said form support forms a track, said support structure including a form suspension trolley mounted for horizontal movement to and from along said track.

11. A concrete form suspension system as claimed in claim 5, wherein said support structure comprises vertically extending beams and horizontally extending beams secured to said vertically extending beams so as to form a rigid structure, an upper one of said horizontally extending beams forming said form support.

12. A concrete form suspension system as claimed in claim 5, wherein said support structure has lateral projections engageable with said support members and thereby supporting said support structure on said support members, said lateral projections being mounted for inward movement relative to said support structure, during the raising of said support structure, to allow said lateral projections to move upwardly towards said support members.

13. A concrete form suspension system as claimed in claim 12, wherein said lateral projections are pivotally secured to said support structure to allow the inward movement of said lateral projections.

14. A concrete form suspension system, comprising:

a vertically displaceable support structure;

a form support projecting laterally from an upper portion of said support structure;

a lifting device operable to raise said support structure along a vertically extending concrete structure;

a support device supporting the lifting device;

said support device being provided with means for securing said support device to a vertical face of said concrete structure;

support members supporting said support structure from said concrete structure;

said support members being provided with means for securing said support members to vertical faces of said concrete structure; and a pivotal connection between said lifting device and said support device, whereby said support structure is supported on said support device during the raising of said support structure and is pivotable relative to said support device to allow horizontal adjustment of said support structure.

15. A concrete form suspension system as claimed in claim 14, further comprising guide rollers on opposite sides of said support structure for rolling engagement with said concrete structure during the raising of said support structure.

16. A concrete form suspension system as claimed in claim 14, further comprising a pivotal connection between said lifting device and said support structure.

17. A concrete form suspension system as claimed in claim 14, wherein said lifting device comprises a vertical lifting jack, said system further comprising an upper pivotal connection between an upper end of said jack and said support structure, and a lower pivotal connection between said support device and a lower end of said jack, said pivotal connections permitting horizontal adjustment of said support structure relative to said concrete structure.

18. A concrete form suspension system as claimed in claim 14, wherein said form support forms a track, said support structure including a form suspension trolley mounted for horizontal movement to and from along said track.

19. A concrete form suspension system as claimed in claim 14, wherein said support structure comprises vertically extending beams and horizontally extending beams secured to said vertically extending beams so as to form a rigid structure, an upper one of said horizontally extending beams forming said form support.

20. A concrete form suspension system as claimed in claim 14, wherein said support structure has lateral projections engageable with said support members and thereby supporting said support structure on said support members, said lateral projections being mounted for inward movement relative to said support structure, during the raising of said support structure, to allow said lateral projections to move upwardly towards said support members.

21. A concrete form suspension system as claimed in claim 20, wherein said lateral projections are pivotally secured to said support structure to allow the inward movement of said lateral projections.

22. A concrete form suspension system, comprising:

a vertically displaceable support structure;

a form support projecting laterally from an upper portion of said support structure;

a lifting device operable to raise said support structure along a vertically extending concrete structure;

a support device supporting the lifting device;

said support device being provided with means for securing said support device to a vertical face of said concrete structure;

support members supporting said support structure from said concrete structure;

said support members being provided with means for securing said support members to vertical faces of said concrete structure;

alignment members which are extensible and retractable between said support structure and said concrete structure for adjustably horizontally positioning said support structure relative to said concrete structure; and a pivotal connection between said lifting device and said support device, whereby said support structure is supported on said support device during the raising of said support structure and is pivotable relative to said support device to allow horizontal adjustment of said support structure.

* * * * *